US007311157B1

(12) United States Patent
Clarke

(10) Patent No.: US 7,311,157 B1
(45) Date of Patent: Dec. 25, 2007

(54) TOOL FOR CONTROLLING ROTATION OF A BOTTOM HOLE ASSEMBLY WITH RESPECT TO A DRILLSTRING

(75) Inventor: Ralph L. Clarke, SugarLand, TX (US)

(73) Assignee: RPM Tools, Inc., Sugar Land, TX (US)

( * ) Notice: Subject to any disclaimer, the term of this patent is extended or adjusted under 35 U.S.C. 154(b) by 212 days.

(21) Appl. No.: 11/140,172

(22) Filed: May 31, 2005

(51) Int. Cl.
*E21B 7/08* (2006.01)

(52) U.S. Cl. ..... 175/61; 175/74

(58) Field of Classification Search ..... 175/61, 175/73, 75, 74
See application file for complete search history.

(56) References Cited

U.S. PATENT DOCUMENTS 4,641,717 A * 2/1987 Eppink ..... 175/74
4,932,482 A 6/1990 DeLucia
4,962,818 A 10/1990 DeLucia
5,022,471 A 6/1991 Maurer et al.
5,094,305 A 3/1992 Wenzel
5,099,931 A 3/1992 Krueger et al.
5,458,208 A 10/1995 Clarke
2004/0231893 A1* 11/2004 Kent ..... 175/74

FOREIGN PATENT DOCUMENTS

EP 1235834 3/1967
SU 829843 5/1969
SU 832016 11/1978

* cited by examiner

*Primary Examiner*—William P Neuder
(74) *Attorney, Agent, or Firm*—Egbert Law Offices

(57) ABSTRACT

A tool for controlling rotation of a bottom hole assembly with respect to a drillstring has a mandrell with a longitudinal groove and a circumferential groove extending therearound and in communication with the longitudinal groove, a locking element extending around and over at least a portion of the grooves, and an actuator cooperative with the locking element for selectively moving the locking element such that locking member extending from the locking element engages either the longitudinal groove ro the circumferential groove relative to a fluid pressure in the drillstring.

20 Claims, 7 Drawing Sheets

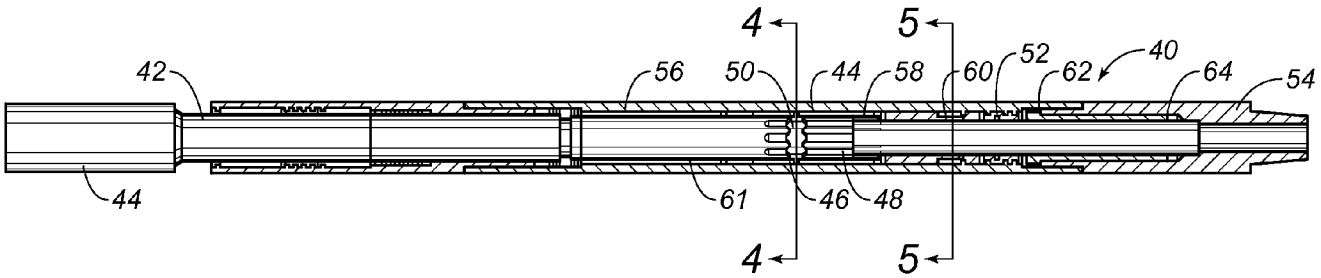
FIG. 3
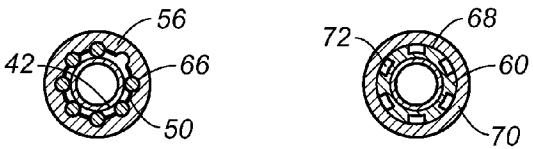
FIG. 4
FIG. 5
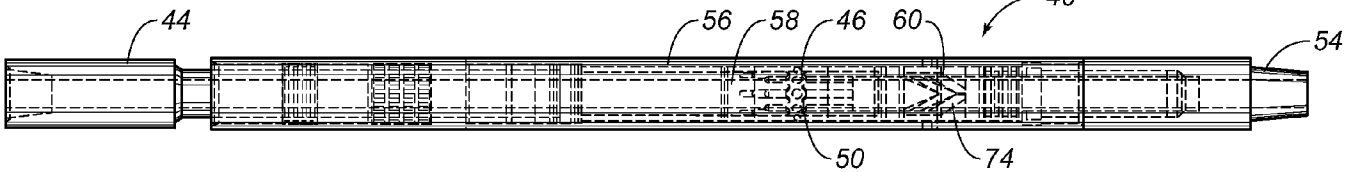
FIG. 6

TOOL FOR CONTROLLING ROTATION OF A BOTTOM HOLE ASSEMBLY WITH RESPECT TO A DRILLSTRING

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to methods of directional drilling. More particularly, the present invention relates to methods of directional drilling that employ bottom hole assemblies attached thereto. More particularly, the present invention relates to tools which allow a bottom hole assembly to rotate and perform its tasks independently of the rotation of the drillstring.

BACKGROUND OF THE INVENTION

In the art of oil field drilling technology, "directional drilling" is becoming increasingly prominent. In directional drilling, the angle of the borehole is altered during the drilling operation from vertical toward horizontal. Initially, directional drilling was developed in order to explore for oil under natural barriers, such as lakes. However, it has been determined that if the borehole passes along, rather than merely vertically traverses, a permeable oil bearing formation, production can be dramatically increased.

It has been recognized that a number of advantages can be gained in drilling wells by employing a stationary drill pipe or drillstring which has attached, at its lower end, a downhole motor. The drive section of the downhole motor is connected to and rotates a drill bit. In such an apparatus, a fluid (such as air, foam, or a relatively incompressible liquid) is forced down the stationary drill pipe or drillstring and on passing through the fluid-operated motor causes rotation of a shaft ultimately connected to the drilling bit. The drillstring is held or suspended in such a manner that it does not rotate and therefore may be regarded as stationary. However, it is lowered in the well as the drilling proceeds.

In directional drilling, drilling motors are utilized wherein a bend may be located in the drillstring above the motor, a bend may be placed in the motor housing below the rotor/stator drive section, or the bit or output shaft can be angularly offset relative to the drive section axis.

In typical bottom hole assemblies (BHA), the motor, the motor housing, and the bit are placed below the MWD (measurement-while-drilling) sensors. These MWD sensors include accelerometers and/or magnetometers which are positioned in the MWD so as to form part of the bottom hole assembly. These sensors in the MWD can be used so as to determine the inclination and/or azimuth of the hole. Typically, the information from the MWD is transmitted to a surface location so that the position of the bit within the well bore can be properly determined.

In directional drilling applications, it is necessary to stop the rotating of the drillstring so as to properly take a measurement from the MWD. MWD measurements are not taken as the MWD section rotates with the rotating of the drillstring. Whenever the drillstring rotation is stopped, there is a tendency for the drillstring to contact the walls of the borehole. Such contact can occur from a buckling of the drillstring caused by the downward slide of the drillstring. Alternatively, the downhole formation can collapse inwardly onto the drillstring so as to create contact forces with the surface of the drillstring. In normal operation, when the rotation of the drillstring is stopped, the bit motor causes the bit to rotate and the drillstring slides downwardly so as to move the bit downwardly in the hole. If the drillstring should become "hung up" on the sides of the borehole, then the continued lowering of the drillstring will simply cause the drillstring to buckle. Drilling progress becomes rapidly inhibited by such contacts between the drillstring and the borehole wall. When the drillstring becomes stuck, it is necessary to lift the drillstring, to a certain extent, and to also rotate the drillstring so as to free the drillstring from the contact forces.

In the past, various patents have issued relative to directional drilling operations. U.S. Pat. No. 4,932,482, issued on Jun. 12, 1990, and U.S. Pat. No. 4,962,818, issued on Oct. 16, 1990, both to F. DeLucia, teach a downhole motor with an enlarged connecting rod housing. A drill bit is connected to the lower end of the downhole motor and a bent sub is attached to its upper end. The downhole motor includes a motor housing, a connecting rod housing and a bearing housing. The connecting rod housing has a bend angle formed on the housing, which is enlarged to enable the connecting rod to be tilted at a larger angle than otherwise possible.

U.S. Pat. No. 5,022,471, issued on Jun. 11, 1991 to Maurer et al., teaches a deviated wellbore drilling system suitable for drilling curved wellbores which have a radius of curvature of approximately 10 to 1,000 feet. This system includes a drillstring, a drill bit, and a fluid-operated drill motor having a curved or bent housing section for rotating the drill bit independently of the drillstring. The drilling motor has an elongate tubular rotor/stator drive section containing a rubber stator and a steel rotor and the housing is bent or curved intermediate its ends. A straight or bent universal section below the bent rotor/stator section contains a universal joint for converting orbiting motion of the rotor to concentric rotory motion at the bit. A bearing pack section below the universal section contains radial and thrust bearings to absorb the high loads applied to the bits.

U.S. Pat. No. 5,094,305, issued on Mar. 10, 1992, to K. H. Wenzel, teaches an orientable adjustable bent sub having a tubular member in the form of an adjustment sleeve, with a first end offset to a primary axis so as to telescopically receive the first end of the tubular member. By rotation of the adjustment sleeve, the offset portion of the adjustment sleeve is adjusted in relation to the offset portion of the tubular member so as to produce a bend of desirable magnitude. The adjustment sleeve is axially movable between an engaged position and a disengaged position.

U.S. Pat. No. 5,099,931, issued on Mar. 31, 1992, to Krueger et al., describes a method and apparatus for optional straight hole drilling or directional drilling in earth formations. This apparatus includes a downhole drilling assembly having a drill bit driven by a downhole motor and a deflection element in the assembly for imparting an angle of deflection to the drill bit relative to drillstring above the drilling assembly. At least two stabilization points for the drilling assembly in the borehole are used, with the drill bit, to define an arcuate path for the drilling assembly when the downhole motor is operating but the drillstring is not rotating.

German Patent No. 1,235,834, published on Mar. 9, 1967, describes a turbo-drill having a fixed shaft and a rotary body. A rotor and a stator form three differently sized groups so as to make up a turbo-convertor. Soviet Patent No. 832,016, published on Nov. 15, 1978, teaches a downhole motor for drills that has straight brake rim teeth with one tooth difference between rims for higher rotative moment on an output shaft. Soviet Patent No. 829,843, published on May 4, 1969, describes a turbodrill for downhole operations. This turbodrill has a flexible fluted ring received in a round stator boss groove to prevent twisting under blade reaction.

U.S. Pat. No. 5,458,208, issued on Oct. 17, 1995 to the present inventor, describes a method of directional drilling including the steps of affixing a bit, a motor housing, a MWD, and a sub to an end of a drillstring, forming a hole in the earth by rotating the bit such that the drillstring lowers into the earth, actuating the sub such that the MWD is stationary as the drillstring rotates. The motor housing and the MWD are connected to the drillstring such that the MWD rotates in correspondence with the motor housing. The sub has a first portion connected to the drillstring and a second portion connected to the motor housing. The step of actuating includes indexing a gear member within the sub such that the first portion rotates independently of the second portion.

It is an object of the present invention to provide a tool that allows a drillstring to be rotated independently of the bottom hole assembly. More particularly, it is an object of the present invention to provide a tool that selectively allows the drillstring to either be rotated in correspondence with the bottom hole assembly or independently of the bottom hole assembly.

It is a further object of the present invention to provide a tool which allows the fluid pressure passing through the drillstring to properly control whether the drillstring and the bottom hole assembly rotate relative to each other.

It is another object of the present invention to provide a method that minimizes contact interference with the movement of the drillstring in the wellbore.

It is another object of the present invention to provide a method that reduces instances of drillstring buckling in the wellbore.

It is a further object of the present invention to provide a method for carrying out downhole measurements which allows for the adjustment of the tool face orientation without stopping the rotation of the drillstring.

These and other objects and advantages of the present invention will become apparent from a reading of the attached specification and appended claims.

BRIEF SUMMARY OF THE INVENTION

In one aspect of the present invention, a tool is provided for controlling the rotation of a bottom hole assembly with respect to a drillstring. This tool includes a mandrell having at least one longitudinal groove formed on an outer diameter thereof and a circumferential groove formed on the outer diameter thereof in communication with the longitudinal groove. A locking element extends around and over at least a portion of the longitudinal groove and the circumferential groove. The locking element has a locking member with a size suitable for being received in the longitudinal groove and the circumferential groove. An actuator is cooperative with the locking element for selectively moving the locking member between one of either the longitudinal groove or the circumferential groove relative to the fluid pressure in the drilling string.

The longitudinal groove of the mandrell has a first portion extending on one side of the circumferential groove and a second portion extending on an opposite side of the circumferential groove. The first portion is longitudinally aligned with the second portion. In particular, the mandrell has a plurality of longitudinal grooves extending around the mandrell and evenly radially spaced from each other therearound. The circumferential groove will communicate with each of the plurality of longitudinal grooves.

The locking element includes a cage that surrounds the mandrell. The cage has the locking member extending inwardly therefrom. The cage is movable by the actuator such that the locking member is positioned in either of the longitudinal groove or the circumferential groove. In one form of the present invention, the locking member includes a plurality of pins arranged so as to be received in the longitudinal grooves. In another form of the present invention, the locking member includes a plurality of spherical members that are arranged so as to be received in the longitudinal grooves.

The actuator of the present invention has a cam that is cooperative with the locking element. The cam has a slot pattern formed therein. A piston engages the cam so as to axially move the cam in response to the fluid pressure. A pin engages the slot pattern so as to define a position of the locking elements with respect to the longitudinal groove and the circumferential groove. The slot pattern of the cam extends circumferentially around the cam. The slot pattern sequentially defines a first position in which the locking member engages the longitudinal groove on one side of the circumferential groove and a second position in which the locking member freely moves in the circumferential groove. A third position is also defined in which the locking member engages the longitudinal groove on an opposite side of the circumferential groove. A spring is cooperative with the cage on a side opposite the actuator. This spring exerts a force upon the cage opposite the force exerted by the actuator upon the cage. A collar surrounds the mandrell, the locking element and the cage. A first rotary connection is interconnected to the mandrell. A second rotary connection is interconnected to the collar. The first rotary connection is selectively rotatable with respect to the second rotary connection relative to a position of the locking member in either the longitudinal groove or the circumferential groove.

The present invention is also a method of controlling the rotation of a bottom hole assembly with respect to a drillstring. This method includes the steps of: (1) affixing a tool between the bottom hole assembly and the drillstring in which the tool has a first tubular segment having a longitudinal groove and circumferential groove communicating between each other and a second tubular segment with a locking element such that the locking element is received longitudinal groove; and (2) fluidically pressurizing an interior of the tool so as to move the locking element into the circumferential groove.

In this method of the present invention, the tool is formed so as to have a mandrell. This mandrell has the longitudinal grooves thereon. The plurality of longitudinal grooves has a first position extending on one side of the circumferential groove and a second position extending on an opposite side of the circumferential groove. The locking element is positioned over the mandrell such that the locking element has a locking member engaging one of the longitudinal grooves.

A cam is arranged adjacent to an end of the locking element such that a movement of the cam correspondingly moves the locking element.

The step of fluidically pressurizing comprises applying fluid pressure through the drillstring such that the cam urges the locking element such that the locking member enters the longitudinal groove, and rotating the bottom hole assembly independently of the drillstring.

Still further, the method of the present invention has the step of reducing fluid pressure passing through the interior of the tool such that the locking member moves into the longitudinal groove on an opposite side of the circumferential groove. In this embodiment, the drillstring is rotated in correspondence with the rotation of the bottom hole assembly. Still further, fluid pressure can be increased through the interior of the tool such that the locking member moves into the longitudinal groove from the circumferential groove and such that the drillstring is rotated in correspondence with the bottom hole assembly.

BRIEF DESCRIPTION OF THE SEVERAL VIEWS OF THE DRAWINGS

FIG. 3 is a cross-sectional view showing the tool in accordance with present invention.

FIG. 4 is a cross-sectional view taken across lines 4-4 of FIG. 3.

FIG. 5 is a cross-sectional view taken across lines 5-5 of FIG. 3.

FIG. 6 is a diagrammatic illustration of the tool of the present invention in which the bottom hole assembly is able to rotate freely with respect to the drillstring.

DETAILED DESCRIPTION OF THE INVENTION

Figure 1:
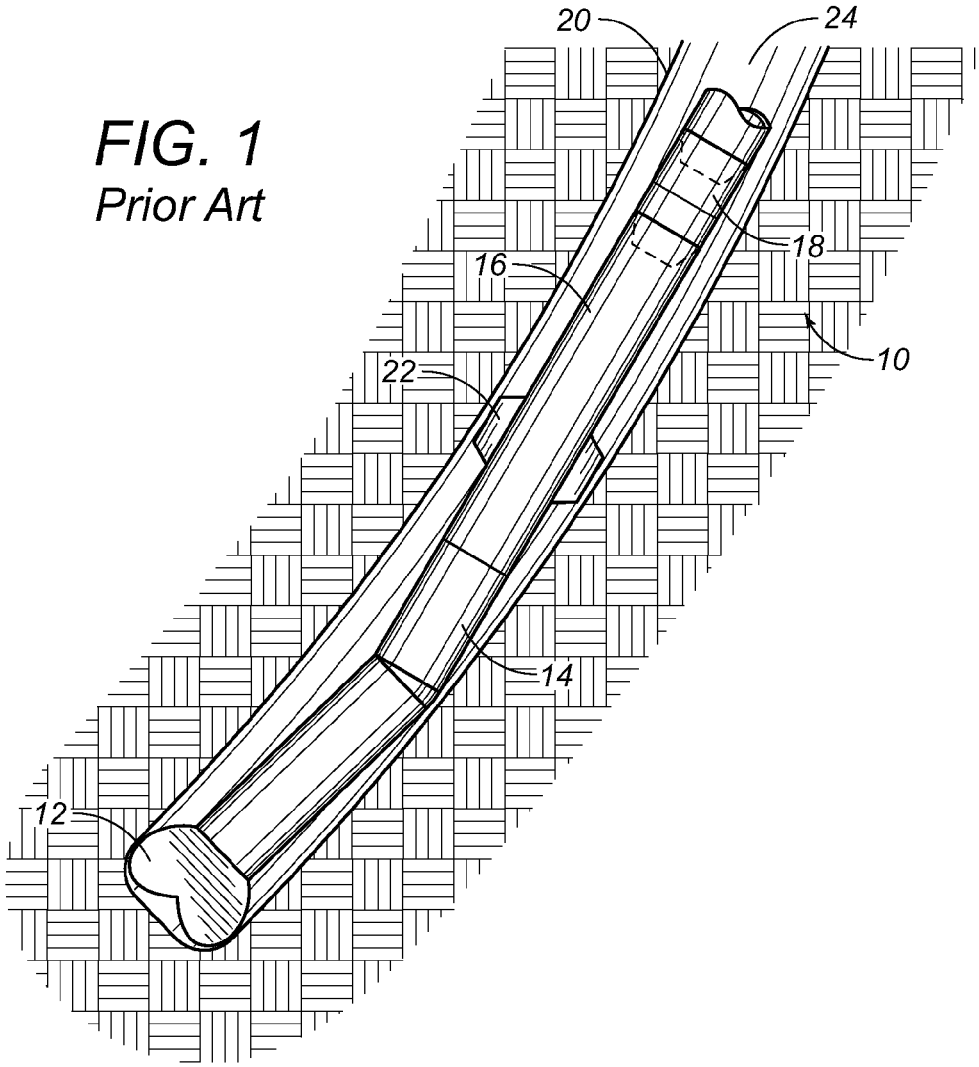
FIG. 1 Prior Art
FIG. 1 is a diagrammatic illustration showing the bottom hole assembly associated with the present invention.

FIG. 1 illustrates a bottom hole assembly 10 which is used in accordance with the method of the present invention. The bottom hole assembly 10 includes a bit 12, a downhole motor 14 having a bent housing, a MWD 16, and the rotating slide sub 18. The bit 12 is connected to a motor located within the bent housing 14. The MWD 16 is positioned above the motor housing 14 within the borehole 20. A stabilizer 22 can be affixing to the exterior of the MWD 16 so as to centralize the MWD 16 within the borehole 20. The rotating slide sub 18 is positioned at the end of the MWD 16 opposite the bent housing 14. A drillstring 24 has an end connected within the rotating slide sub 18. The borehole 20 has a generally curved configuration. This curved configuration is indicative of directional drilling of the well. The bit 12 continues to rotate as the drillstring 24 is lowered into the earth. A rotation of the bit 12 is accomplished by the passing of the drilling fluid to the motor within the bent housing 14. As the motor receives the drilling fluid, the bit 12 is rotated so as to form the borehole 20. The MWD 16 includes conventional MWD components, such as accelerometers and magnetometers. These sensors are capable of measuring the inclination and azimuth of the well bore. Various sensor systems and measurements are carried out so as to properly locate the location of the bit 12 within the hole. Conventionally, the MWD 16 will have suitable telemetry associated with it so as to pass the assessed information to a surface location above the borehole 20.

After the surface location has received the signals concerning the location of the bit 12 within the borehole 20, computations are carried out so as to determine whether the bit 12 is in a proper location during the directional drilling operation. These computations and calculations are necessary so as to assure that the drilling operation proceeds in accordance with the lease. Additionally, proper control over the direction of the bit 12 must be carried out so as to prevent undue contact forces from affecting the speed of drilling. These contact forces can occur anywhere along the well of the borehole 20. These contact forces occur when the drillstring 24, or any component of the bottom hole assembly, contacts the side of the borehole 20. When the normal drilling procedure is carried out, there should be minimal contact between the borehole 20 and the drillstring 24. However, under many circumstances, the interior of the borehole 20 is not smooth. In other circumstances, portions of the side wall of the borehole 20 can collapse so as to "clog" the drilling pathway. In certain normal procedures, the drillstring 24 is not rotated but simply slides downwardly through the hole as the bit 12 rotates. When the drillstring 24 slides downwardly through the hole 20, the speed of drilling is reduced proportionately to the amount of contact between the wall of borehole 20 and the surface of the drillstring 24. Often, a buckling of the drillstring 24 will occur when the drillstring 24 is lowered faster than the rate of drilling 12.

Many of these problems can be avoided as long as the drillstring 24 is rotated as the drillstring 24 is lowered within the hole 20. However, whenever the drillstring 24 is rotated, in accordance with prior procedures, the MWD 16 will also rotate. As a result, proper measurements cannot be carried out from the MWD 16. Whenever measurements are necessary, then the drillstring 24 must be stopped so that proper position information can be received from the MWD. Whenever the rotation of the drillstring 24 is stopped, circumstances develop where the rate of drilling and undesirable contact forces result. As such, the rotating slide sub 18 was developed so as to allow the drillstring 24 to continue to rotate within the borehole 20. The rotating slide sub 18 has one end connected to the drillstring 24 and another end connected to the MWD 16. When properly actuated, the sub 18 will allow the drillstring 24 to rotate while the MWD is rotationally stationary. As such, the drillstring 24 can rotate while the MWD 16 can carry out its measurements in a stationary position. Since the MWD 16 is affixed to the motor housing 14, the motor housing 14 will remain stationary whenever the MWD 16 is stationary. When the sub 18 is actuated so as to cause a rotation of the MWD 16, the motor housing 14 will rotate in correspondence with the rotation of the MWD 16. Under other circumstances, by passing drilling fluid through the interior of the drillstring 24, through the sub 18, and through the MWD 16, the motor within the housing 14 can be properly driven such that the bit 12 will rotate, even though the motor housing 14 and MWD 16 remain stationary.

Figure 2:
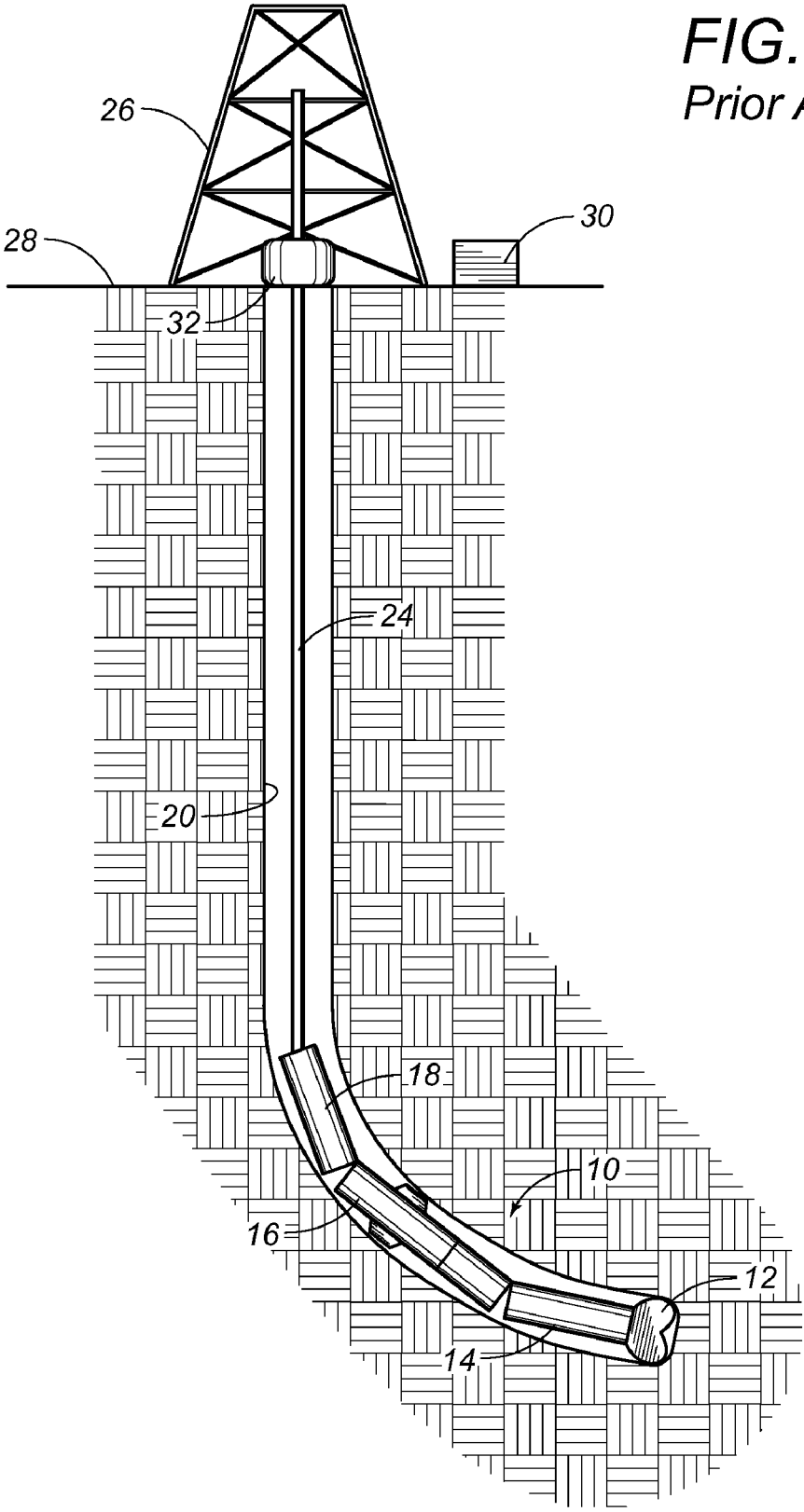
FIG. 2 Prior Art
FIG. 2 is an illustration of the configuration of a directional drilling operation employing the tool and method of the present invention.

In FIG. 2, it can be seen that the drilling rig 26 is positioned on the surface 28 of the earth. The processing equipment 30 is also positioned on the surface of the earth 28. Processing equipment 30 receives the signals from the MWD 16 so as to allow for the operator at the surface to properly determine the location of the bit 12 within the borehole 20. The drillstring 24 extends downwardly through the borehole 20 and is received by the sub 18 associated with the bottom hole assembly 10. The drillstring 24 can be rotated through the use of a rotary table 32 located at the surface 28. Suitable hydraulics can be employed, in a conventional manner, with the drillstring 24 so as to allow for the drilling fluid to pass to the motor within the motor housing 14.

In FIG. 3, there is shown the tool 40 in accordance the teachings of the present invention. The tool 40 includes a mandrell 42 having a rotary connection 44 at one end thereof. A locking element 44 extends around at least a portion of the mandrell 42. The locking element 44 has a locking member 46 extending thereinto so as to be engageable with one of the longitudinal grooves 48 or the circumferential groove 50 at the end of the mandrell 42 interior of the locking element. An actuator 52 is positioned on end of the locking element 44 so as to control the movement of the locking member 46 relative to either the longitudinal groove 48 or the circumferential groove 50. A rotary connection 54 is interconnected to the locking element 44 at an end opposite the rotary connection 44 of the mandrell 42.

It is important to note that in FIG. 3, various other components of the present invention are particularly illustrated. As can be seen, a collar 56 extends over and around the mandrell 42. Ideally, the locking member 46 will extend from the interior of the collar 56 through a cage 58 positioned interior thereof. A spring 61 will be interposed against an end of the cage 58 so as to urge the cage in the direction toward the rotary connection 54. A cam 60 is positioned adjacent to an end of the cage 58. The cam, as will be described hereinafter, can be actuated upon by the actuator 52 so as to move axially within the interior of the collar 56 so as to properly move the cage 58 and the orientation of the locking member 46 with respect to either the longitudinal grooves 48 or the circumferential groove 50. A mud-lubricated radial bearing 62 is positioned adjacent to the opposite end of the actuator 52. A cross-over rib 64 will extend to the rotary connector 54.

FIG. 4 illustrates a cross-sectional view taken across lines 4-4 of FIG. 3. In particular, it can be seen that the collar 56 has a plurality of spherical members 66 extending inwardly therefrom. The spherical members 66 are the same as the locking members 46, as illustrated in FIG. 3. These spherical members 66 are received within the circumferential groove 50 formed in the mandrell 42. When the spherical members 66 are received within the circumferential groove 50, the mandrell 42 will be independently rotatable relative to the bottom hole assembly, or those items that are connected to the rotary connection 54. It should be noted that when the spherical members 66 move into one of the longitudinal grooves 48, the collar 56 will be fixed and the mandrell 42 will rotate in correspondence with any items that are connected to the rotary connection 54.

FIG. 5 illustrates the cross-sectional view of the cam 60. As can be seen, the cam 60 includes a snap ring 68 and a retainer 70. Pins 72 extends so as to engage the slot pattern (as will be described hereinafter) on the cam 60.

FIG. 6 shows a further sectional view of the tool 40. In particular, in FIG. 6, the tool 40 is illustrated such that the rotary connection 44 (along with the components connected thereto) are freely rotatable relative to the components connected to the rotary connector 54. This is the result of the locking member 46 being positioned within the circumferential groove 50. Cage 58 is illustrated as interior of the collar 56. The cam 60 is illustrated as having the slot pattern 74 extending thereover and therearound. The pins 72 engage the slot pattern in a desired location so as to assure that the locking member 46 resides in a freely rotatable relationship within the circumferential groove 50.

Figure 7:
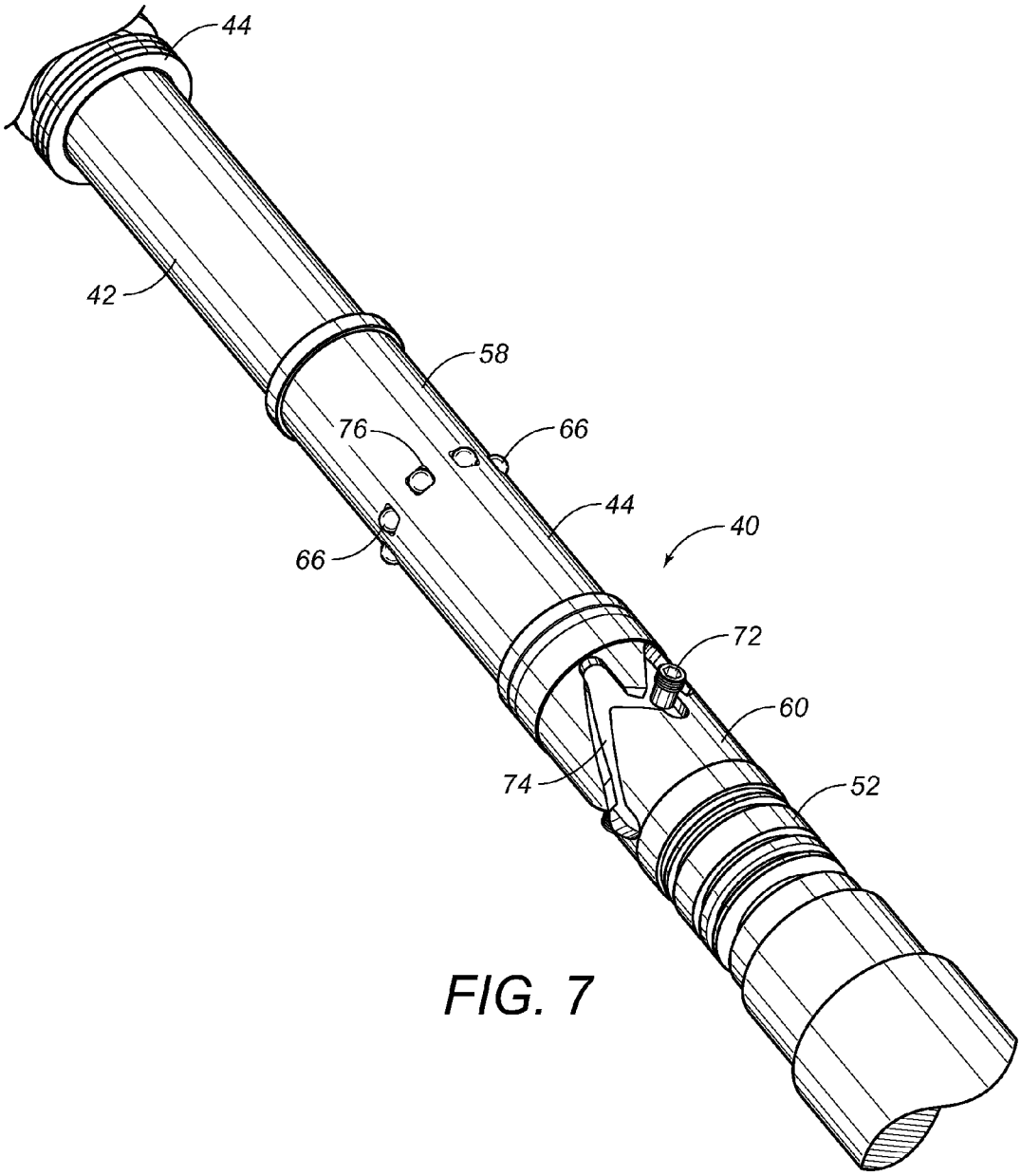
FIG. 7 is a perspective view showing the tool assembly of the present invention.

FIG. 7 is a diagrammatic illustration of the tool 40 of the present invention. In particular, it can be seen that the mandrell 42 extends from the rotary connection 44. The cage 58 extends over at least a portion of the mandrell 42. A plurality of spherical members 66 (otherwise known as the locking members 46) will extend through openings 76 formed the wall of the cage 58. It should be noted that the spherical members 66 can be in the nature of balls or solid pins. If spherical balls are used as the locking members 66, then they may facilitate more even rotation of various tubular components in the tool 40. Cam 60 is positioned adjacent to an end of the cage 58. A pin 72 extends through the slot pattern 74 of the cam 60. As such, as the actuator 52 urges on the cam 60, the pin 72 will follow the slot pattern 74 so as to properly move the locking element 44 and its associated spherical members 66 in a desired position relative to the longitudinal groove 48 or the circumferential groove 50 of the mandrell 42. It should be noted that the slot pattern 74 has a particular configuration whereby the locking member 46 can selectively be positioned in one of the longitudinal grooves 48 on one side of the circumferential groove 50 or on an opposite side of the circumferential groove 50. As such, the locking relationship between the components connected to the opposite ends of the tool 40 can be controlled with by one of three positions.

Figure 8:
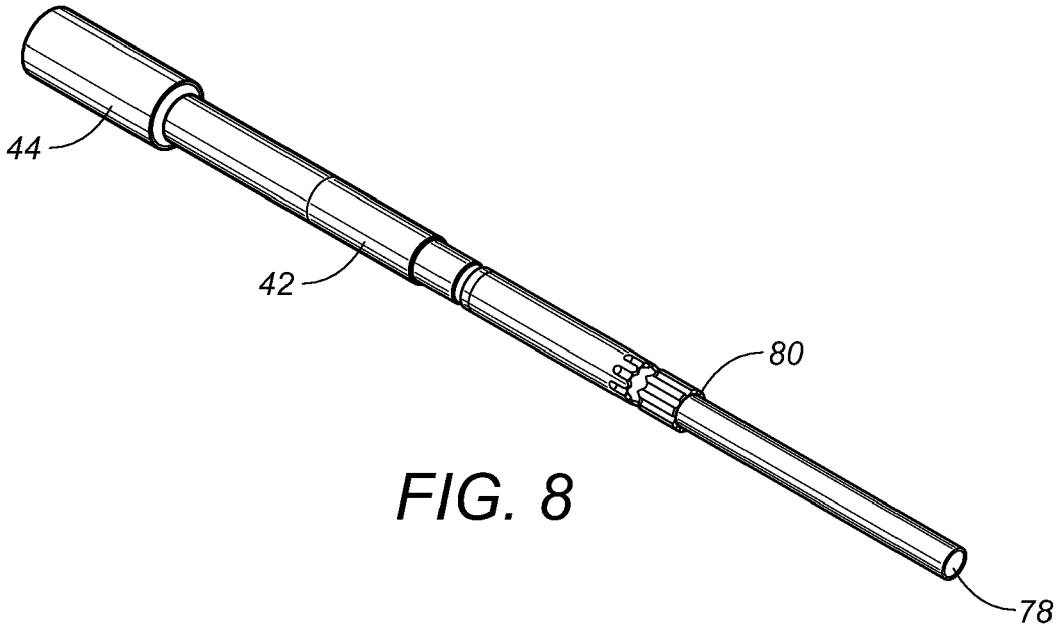
FIG. 8 is a perspective view showing the mandrell as used within the tool assembly of the present invention.

FIG. 8 illustrated, in particular, the mandrell 42 as used in the present invention. The mandrell 42 has rotary connector 44 at one end thereof. The mandrell 42 is suitably hollow so as to have interior passageway 78 extending axially therethrough. As such, the mandrell 42 can allow fluids to properly pass through the interior of the tool 40.

Figure 9:
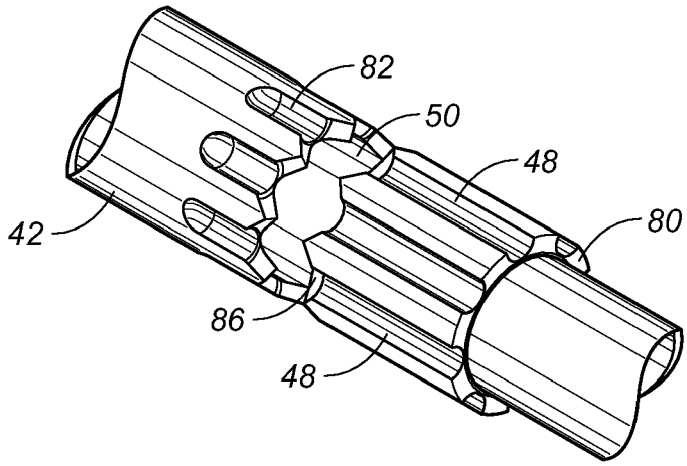
FIG. 9 is a detailed view showing the arrangement of longitudinal grooves and circumferential grooves on the mandrell associated with the tool of the present invention.

FIG. 9 shows a detailed view of the groove pattern located adjacent to the shoulder 80 on the mandrell 42. As can be seen, a plurality of longitudinal grooves 48 are evenly radially spaced around the outer diameter of the mandrell 42. Each of the longitudinal grooves 48 communicates with the circumferential groove 50. In particular, each of the longitudinal grooves 48 has a first portion 82 located on one side of the circumferential groove 50 and a second portion 84 located on an opposite side of the circumferential groove 50. The circumferential groove 50 has funnel sections 86 opening to each of the longitudinal grooves 48 on opposite sides of the circumferential groove 50. This facilitates the ability for the locking member to enter a desired position within the respective longitudinal grooves 48. The clearance between the narrow sections of the circumferential groove 50 should be wider than the diameter of the locking member (if a spherical member) or a width or thickness of the locking member (if a pin).

Figure 10:
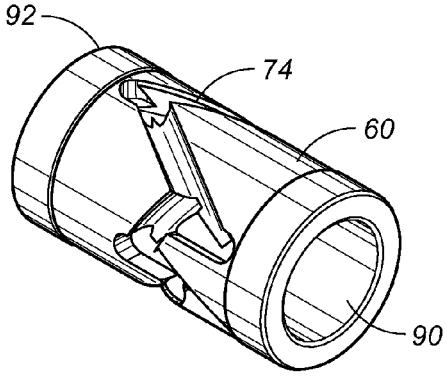
FIG. 10 is perspective view showing the cam as used in the tool of the present invention.

FIG. 10 illustrates an isolated view of the cam 60. As can be seen, the cam 60 is a tubular member having an interior passageway 90. An end 92 of the cam 60 will contact the end of the cage 58. The slot pattern 74 will extend around the circumference of the cam 60 in a unique configuration. Through the arrangement of the slot pattern 70, the cam 60 will be rotatable, in a controlled manner, around the diameter of the mandrell 78.

Figure 11A:
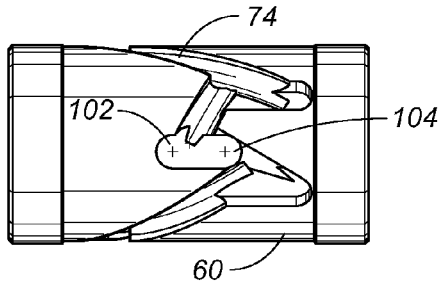
FIGS. 11A-11C illustrate the various positions in which the cam can be manipulated so as to control the position of the locking member within the grooves of the mandrell.
Figure 11B:
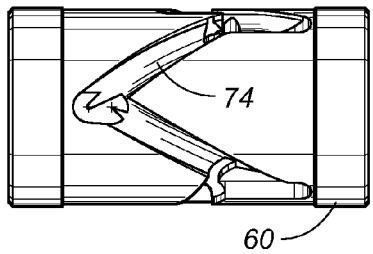
Figure 11C:
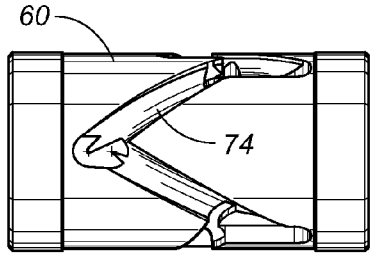
Figure 12:
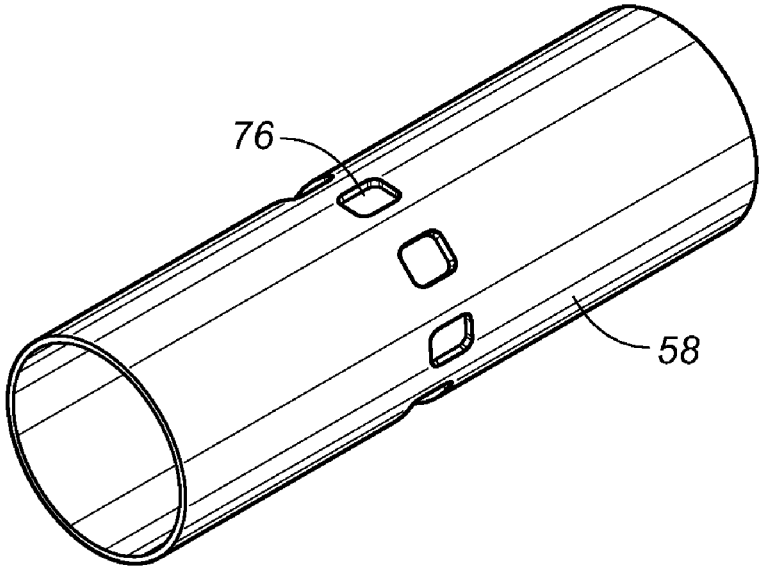
FIG. 12 is a perspective view showing the cage associated with the tool of the present invention.
Figure 13:
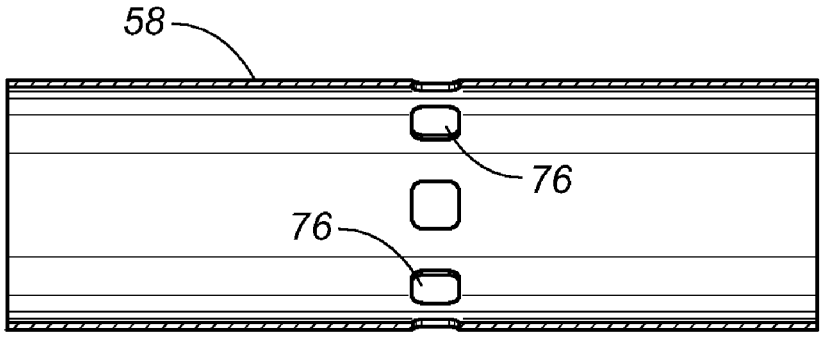
FIG. 13 is a cross-sectional view of the cage of FIG. 12.

FIGS. 11A-11C show the various positions of the cam 60 with respect to a pin received therein. In FIG. 11, the portion 100 of the slot pattern 74 will be a first position of the locking member with respect to the longitudinal and circumferential grooves. This first position will have the rotary connections 44 and 54 with respect to each other when the pressure of the fluid within the interior of the tool 40 falls below a desired threshold. A second position along with the drillstring. Secondly, the drillstring can be rotated while the section below the tool 40 is independent of the rotation of the drillstring. The bottom hole assembly below the tool 40 can be controlled by other means. In other words, the bottom hole assembly, along with the motors associated therewith, can be rotated independently of any rotation applied to the drillstring.

The bottom hole assembly, as used herein, includes, but is not limited to, items in the drillstring that are located below the drill pipe. For example, the bottom hole assembly can include a bit, a motor with a bend, a float sub, a MWD (collar), the tool, and a non-magnetic collar. There are three positions of the tool: (1) locked with pressure below threshold; (2) locked with pressure above threshold; and (3) unlocked with pressure above threshold.

In the method of the present invention can provide a sequence of operations in which, when the pumps are off, the tool 40 will be in its locked position. As the pumps start to pump fluid, the pressure within the drillstring will increase and move the piston-type actuator 52 against the cam 60 to a predefined position which forces the cage 58 (along with its locking assembly) to move to a predefined position. In this position, the locking assembly, which includes either balls or pins, would be in one of two positions with the pressure above the threshold. If this position is locked with the balls or pins in the longitudinal grooves 48 of the mandrell 42, the tool 40, along with the bottom hole assembly, will rotate with the upper section. When changing to another position, the pumps will be slowed or stopped. This causes the interior pressure within the tool 40 to be below the pressure threshold. As a result, the spring 61 will push the cage 58 and its locking assembly back in the other direction against the cam 60 so as to index over and also to move the piston-type actuator 52 back to the home position. Once again, the tool 40 is in a locked position with the pressure below threshold. When the pumps are restarted or the pressure within the drill pipe exceeds the pressure threshold, the piston 52 moves against the cam 60 so as to move to another predefined position. This also moves the cage 58 and its associated locking assembly to another predefined position. The balls or pins associated with the locking assembly will be engaged with the circumferential groove 50 on the mandrell 42 so as to allow the mandrell 42 to turn without turning the outer housing. This results in turning the drillstring independently of the lower section of the tool 40 and the bottom hole assembly. By changing the speed and weight-on-bit, one can control the orientation of the bottom hole motor.

In the present invention, the actuation force is provided by the inner diameter to an annulus pressure differential acting on or across the seal area of the actuator 52. One side of the actuator is exposed to inner diameter mud pressure. The other side is exposed to oil which is coupled to annulus pressure by a mud/oil interface (a piston, a membrane, a bellows, etc.). A pressure balance piston acts axially on the cam 60. The cam will have at least three axial location settings or stops. The axial movement of the cam 60 will act on and control the axial position of the cage 58. The cage 58, in turn, will actuate its associated locking members. These locking members can be in the form of keys, pins, balls, etc. The locking members couple the mandrell 42 to the collar 56 by providing a shear bearing member between the axial outer diameter grooves in the mandrell 48 and the axial inner diameter grooves in the collar 56. The cage 58 is acted by a spring 61 which counters the pump-on actuation force. In one mode, the spring 61 forces the locking member 46 into one of the longitudinal grooves so as to rotationally couple the mandrell 42 to the housing. In another mode, the actuator forces the cam 60 into one of its axial position. This position allows axial movement sufficient to engage the locking members 46 in another set of longitudinal grooves. This, once again, rotationally couples the mandrell 42 to the housing. In a third mode, the cam 60 stops the axial movement where the locking members 46 are not engaged with either of the longitudinal grooves on either the mandrell 42 or the collar 58. This allows relative rotation between the mandrell 42 and the collar 56.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A tool for controlling rotation of a bottom hole assembly with respect to a drillstring comprising:

a mandrell having at least one longitudinal groove formed on an outer diameter thereof, said mandrell having a circumferential groove extending therearound and in communication with the longitudinal groove;

a locking element extending around and over at least a portion of the longitudinal groove and over said circumferential groove, said locking element having a locking element with a size suitable for being received within the longitudinal groove and said circumferential groove; and an actuator means cooperative with said locking element for selectively moving said locking member between one of the longitudinal groove and said circumferential groove relative to a fluid pressure in the drillstring.

2. The tool of claim 1, the longitudinal groove of said mandrell having a first portion extending on one side of said circumferential groove and a second portion extending on an opposite side of said circumferential groove.

3. The tool of claim 2, said first portion being longitudinally aligned with said second portion.

4. The tool of claim 1, the longitudinal groove comprising a plurality of longitudinal groove extending around said mandrell and evenly radially spaced therearound, said circumferential groove communicating with said each of the longitudinal grooves of said plurality of longitudinal grooves.

5. The tool of claim 1, said locking element comprising:

a cage surrounding said mandrell, said cage having said locking member extending inwardly therefrom, said cage movable by said actuator means such that said locking member is positioned in one of the longitudinal groove and the circumferential groove.

6. The tool of claim 5, said locking member comprising a plurality of pins arranged so as to be received in the longitudinal groove.

7. The tool of claim 5, said locking member comprising a plurality of spherical members arranged so as to have at least a portion thereof received in the longitudinal groove.

8. The tool of claim 1, said actuator means comprising:

a cam cooperative with said locking element, said cam having a slot pattern formed therein;

a piston engaging said cam so as to axially move said cam in response to a fluid pressure in the drilling string; and a pin engaging said slot pattern so as to define a position of said locking member with respect to the longitudinal groove and said circumferential groove.

9. The tool of claim 8, said slot pattern of said cam extending circumferentially around said cam, said slot pattern sequentially defining a first position in which said locking member engages the longitudinal groove on one side of said circumferential groove and a second position in which said locking member freely moves in said circumferential groove.

10. The tool of claim 9, said slot pattern further defining a third position in which said locking member engages the longitudinal groove on an opposite side of circumferential groove.

11. The tool of claim 5, further comprising:

a spring cooperative with said cage on an opposite side said actuator means, said spring exerting a force upon said cage opposite a force exerted by said actuator means upon said cage.

12. The tool of claim 5, further comprising:

a collar surrounding said mandrell and said locking element and said cage;

a first rotary connection interconnected to said mandrell; and a second rotary connection interconnected to said collar, said first rotary connection being selectively rotatable with respect to said second rotary connection relative to a position of said locking member in either the longitudinal groove or said circumferential groove.

13. A method of controlling rotation of a bottom hole assembly with respect to a drillstring comprising:

affixing a tool between the bottom hole assembly and the drillstring, said tool having a first tubular segment having a longitudinal groove and circumferential groove in communication therewith and a second tubular segment with a locking element, said locking element received in the longitudinal groove; and fluidically pressurizing an interior of said tool so as to move said locking element into said circumferential groove.

14. The method of claim 13, further comprising:

forming said tool so as to have a mandrell, said mandrell having a plurality of longitudinal grooves thereon, said plurality of longitudinal grooves having a first position extending on one side of said circumferential groove and a second position extending on an opposite side of said circumferential groove;

positioning a locking element over said mandrell, said locking element having a locking member engaging at least one of said plurality of longitudinal grooves; and arranging a cam adjacent to an end of said locking element such that a movement of said cam correspondingly moves said locking element.

15. The method of claim 14, said step of fluidically pressurizing comprising:

applying fluid pressure through said drillstring such that said cam urges said locking element such that said locking member enters said circumferential groove: and rotating said bottom hole assembly independently of said drillstring.

16. The method of claim 14, further comprising:

reducing fluid pressure passing through said interior of said tool such that said locking member moves into the longitudinal groove on an opposite side of said circumferential groove; and rotating said drillstring in correspondence with a rotation of said bottom hole assembly.

17. The method of claim 14, further comprising:

increasing fluid pressure passing through said interior of said tool such that said locking member moves into said longitudinal groove from said circumferential groove; and rotating said drillstring in correspondence with a rotation of said bottom hole assembly.

18. The method of claim 14, further comprising:

forming said cam so as to have a slot pattern formed therein and extending therearound;

extending a pin into said slot pattern; and moving said cam such that said pin follows a desired pattern through said slot pattern.

19. The method of claim 13, further comprising:

affixing a mandrell to the drillstring, said mandrell having the longitudinal groove and said circumferential groove thereon, said mandrell being said first tubular segment;

positioning a collar over said mandrell, said collar having said locking element extending interiorly therefrom; and interconnecting said collar to the bottom hole assembly.

20. The method of claim 19, said second tubular segment being a cage slidably positioned over the longitudinal groove and said circumferential groove of said mandrell, said locking element extending through an opening in said cage so as to engage one of said grooves, said cage being said second tubular segment.

* * * * *